US008314571B2

(12) United States Patent
Jonsson

(10) Patent No.: US 8,314,571 B2
(45) Date of Patent: Nov. 20, 2012

(54) LIGHT WITH CHANGEABLE COLOR TEMPERATURE

(75) Inventor: Karl Jonsson, Rancho Santa Margarita, CA (US)

(73) Assignee: Greenwave Reality, PTE, Ltd., Singapore (SG)

( * ) Notice: Subject to any disclaimer, the term of this patent is extended or adjusted under 35 U.S.C. 154(b) by 0 days.

(21) Appl. No.: 13/232,988

(22) Filed: Sep. 14, 2011

(65) Prior Publication Data

US 2012/0146505 A1 Jun. 14, 2012

(51) Int. Cl.
*H05B 37/00* (2006.01)

(52) U.S. Cl. ..... 315/291; 315/112; 315/192; 315/307

(58) Field of Classification Search ..... 315/291, 315/224, 307, 308, 185 R, 191, 192, 193, 315/186, 246, 250, 251, 112, 113, 117, 118
See application file for complete search history.

(56) References Cited

U.S. PATENT DOCUMENTS

| | | | | |
|---|---|---|---|---|
| 2008/0224631 | A1 | 9/2008 | Melanson | |
| 2009/0153076 | A1* | 6/2009 | Huang et al. | 315/294 |
| 2009/0315480 | A1 | 12/2009 | Yan et al. | |
| 2010/0001648 | A1* | 1/2010 | De Clercq et al. | 315/113 |
| 2010/0171437 | A1* | 7/2010 | Van Herpen et al. | 315/250 |
| 2011/0248640 | A1* | 10/2011 | Welten | 315/210 |
| 2011/0291587 | A1* | 12/2011 | Melanson et al. | 315/291 |
| 2012/0002455 | A1* | 1/2012 | Sullivan et al. | 365/51 |
| 2012/0081015 | A1* | 4/2012 | Shimomura et al. | 315/188 |

FOREIGN PATENT DOCUMENTS

| | | | |
|---|---|---|---|
| JP | 06260287 | A | 9/1994 |
| JP | 2001185371 | A | 7/2001 |
| JP | 2006072820 | A | 6/2006 |

OTHER PUBLICATIONS

International Search Report and Written Opinion of the International Searching Authority for PCT/US2010/060208, Aug. 26, 2011.

* cited by examiner

*Primary Examiner* — David Hung Vu
(74) *Attorney, Agent, or Firm* — Bruce A. Young

(57) ABSTRACT

Color temperature of a lighting apparatus that includes a first LED that emits a white light with a first color temperature and a second LED that emits a white light with a second color temperature is managed. The two LEDs are connected in parallel anode to cathode so that current flowing in one direction turns on the first LED and current flowing in the opposite direction turns on the second LED. A controller manages a duty cycle of an alternating current flowing through the two LEDs to control the color temperature and/or the brightness of the lighting apparatus.

20 Claims, 5 Drawing Sheets

LIGHT WITH CHANGEABLE COLOR TEMPERATURE

CROSS-REFERENCE TO RELATED APPLICATIONS

This application claims the benefit under 35 U.S.C. 365(a) of International Application No. PCT/US10/60208 filed on Dec. 14, 2010, the entire contents of which are hereby incorporated by reference.

BACKGROUND

1. Technical Field

The present subject matter relates to lighting. More specifically it relates to controlling the color temperature of a light that uses light emitting diodes (LEDs).

2. Description of Related Art

Current multi-colored light sources may utilize multiple LEDs. In the simplest case, a dual color LED consists of two LED die, each of which emits a different color of light. A more variable multi-colored light source utilizing LEDs may be built using a plurality of LEDs of a variety of colors, commonly some number each of red, green and blue LEDs. A controller may be included that can individually control the intensity of each color of LED or even control the intensity of each individual LED. This allows the controller to generate a wide variety of colors.

A conventional LED die generally emits light in a narrow band of wavelengths. If that wavelength is in the visible range, this gives the LED a distinct color to a human eye. To generate a broader spectrum of light, such as needed to generate a light perceived as "white" by the human eye, a technique may be used where a narrow range of wavelengths generated by a single LED die irradiates and excites a phosphor material to produce visible light, often referred to as a phosphor LED (or PLED). The phosphor may include a mixture or combination of distinct phosphor materials, and the light emitted by the phosphor can include a variety of narrow emission lines distributed over the visible wavelength range such that the emitted light appears substantially white to the human eye.

One example of a phosphor LED is a blue LED illuminating a phosphor that converts blue to both red and green wavelengths. A portion of the blue excitation light is not absorbed by the phosphor, and the residual blue excitation light is combined with the red and green light emitted by the phosphor. Another example of a phosphor LED is an ultraviolet (UV) LED illuminating a phosphor that absorbs and converts UV light to red, green, and blue light.

Different combinations of distinct phosphor materials may give off subtle variations of spectra to emit "white" light at different color temperatures. The correlated color temperature (often simply referred to as color temperature herein) of a light source is the temperature of an ideal black-body radiator that radiates light that is perceived by the human eye to be of a comparable hue to that light source. The temperature is conventionally stated in units of absolute temperature, kelvin (K). Higher color temperatures (5000K or more) are called cool colors (blueish white); lower color temperatures (2000-4000K) are called warm colors (yellowish white through reddish white). While light with a wide range of color temperatures may still be called "white", in reality a white light at 6000K (similar to typical daylight) is actually a different color than a white light at 3000K (similar to an incandescent bulb) or a white light at 9000K (similar to a computer CRT screen). Thus an application needing to adjust the color temperature of a light source may actually require a multi-color light source.

Many applications today would like to be able to adjust the color of the light source or the color temperature of a white light source for its artistic or psychological effects. For non-LED based lighting sources, this has often been done with filters or gels placed over conventional lights. With a variety of filters, a wide variety of different colors (including different color temperatures) can be realized from a conventional lamp. Multi-colored LED light sources utilizing several different colors of LEDs have become popular due to the wide range and fine control that can be achieved using the controller. But if a limited range of finely controlled colors is required, a full set of LEDs with their associated controller may be too expensive and bulky for many applications and even then, the limited spectral content available from LEDs may not provide the ability to create subtle differences in perceived color such as slight variations in color temperature.

SUMMARY

A method of controlling color temperature of a lighting apparatus includes generating an alternating current. The alternating current flows in a first direction for a first amount of time and said alternating current flows in an opposite direction for a second amount of time. The alternating current is sent to a set of light emitting diodes (LEDs) of a lighting apparatus. At least a first LED of the set of LEDs emits a white light with a first color temperature if the alternating current flows in the first direction and at least a second LED of the set of LEDs emits a white light with a second color temperature if the alternating current flows in the opposite direction. A ratio of the first amount of time to the second amount of time is controlled to control a color temperature of light emitted by the lighting apparatus during the period of time.

A lighting apparatus includes a power supply having a first electrical connection and a second electrical connection. The power supply is configured to create an alternating current flowing between the first electrical connection and the second electrical connection. The lighting apparatus also includes a first lighting element that includes a first light emitting diode (LED) and a second lighting element that includes a second LED. The first lighting element has a first anode electrically connected to the first electrical connection of the power supply and a first cathode electrically connected to the second electrical connection of the power supply. The second lighting element has a second anode electrically connected to the second electrical connection of the power supply and a second cathode electrically connected to the first electrical connection of the power supply. The first lighting element is configured to emit a white light having a first color temperature if an operating current flows through the first lighting element from the first anode to the first cathode and the second lighting element is configured to emit a white light having a second color temperature if the operating current flows through the second lighting element from the second anode to the second cathode. A controller is communicatively coupled to the power supply and configured to manage a color temperature of the lighting apparatus by controlling a duty cycle of the alternating current created by the power supply.

BRIEF DESCRIPTION OF THE DRAWINGS

The accompanying drawings, which are incorporated in and constitute part of the specification, illustrate various embodiments of the invention. Together with the general description, the drawings serve to explain the principles of the invention. They should not, however, be taken to limit the invention to the specific embodiment(s) described, but are for explanation and understanding only. In the drawings.

DETAILED DESCRIPTION

Figure 1:
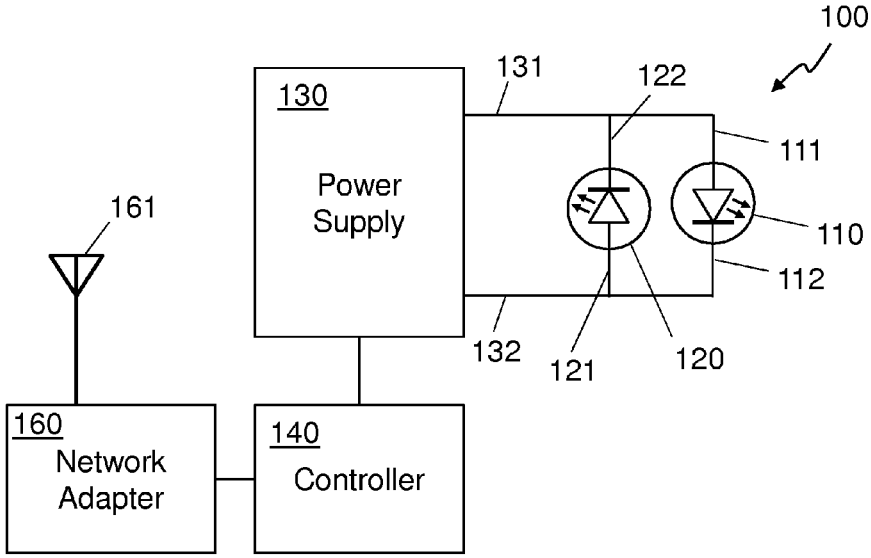
FIG. 1 shows a block diagram of an embodiment of a lighting apparatus.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures and components have been described at a relatively high-level, without detail, in order to avoid unnecessarily obscuring aspects of the present concepts. A number of descriptive terms and phrases are used in describing the various embodiments of this disclosure. These descriptive terms and phrases are used to convey a generally agreed upon meaning to those skilled in the art unless a different definition is given in this specification. Some descriptive terms and phrases are presented in the following paragraphs for clarity.

The term "light emitting diode" or "LED" refers to a semiconductor device that emits light, whether visible, ultraviolet, or infrared, and whether coherent or incoherent. The term as used herein includes incoherent polymer-encased semiconductor devices marketed as "LEDs", whether of the conventional or super-radiant variety. The term as used herein also includes semiconductor laser diodes and diodes that are not polymer-encased. It also includes LEDs that include a phosphor or nanocrystals to change their spectral output. It can also include organic LEDs.

The term "visible light" refers to light that is perceptible to the unaided human eye, generally in the wavelength range from about 400 to about 700 nm.

The term "ultraviolet" or "UV" refers to light whose wavelength is in the range from about 200 to about 400 nm.

The term "white light" refers to light that stimulates the red, green, and blue sensors in the human eye to yield an appearance that an ordinary observer may consider "white". Such light may be biased to the red (commonly referred to as a warm color temperature) or to the blue (commonly referred to as a cool color temperature). As used herein, "white light" should include any light with a correlated color temperature ranging from at least about 1500K to about 10,000K.

The terms "spectral characteristic" and "spectral composition" may be used interchangeably and refer to the set of wavelengths of electromagnetic radiation that combine to make up a particular light source. Light sources that may be perceived as having the same color may comprise different spectral characteristics. For example a light that is perceived as orange may have a spectral characteristic of a single peak at about 600 nm or may have a spectral characteristic with two peaks, one at approximately 500 nm and one at approximately 700 nm. Each wavelength may have a different associated intensity. Two spectral characteristics may be considered substantially similar even if an additional wavelength or small set of wavelengths is present in one but not in the other.

Reference now is made in detail to the examples illustrated in the accompanying drawings and discussed below.

FIG. 1 shows a block diagram of an embodiment of a lighting apparatus 100. Light may be emitted by two lighting elements, which in the embodiment shown in FIG. 1 are two LEDs 110, 120. LED 110 has an anode 111 and a cathode 112. LED 120 has an anode 121 and a cathode 122. LED 110 may emit white light at a first color temperature if current flows through the LED 110 from the anode 111 to the cathode 112 and LED 120 may emit white light at a second color temperature if current flows through the LED 120 from the anode 121 to the cathode 122. The LEDs 110, 120 may block current from flowing through their cathodes 112, 122 to their anodes 111, 121. The LEDs 110, 120 may be phosphor LEDs in many embodiments.

The color temperatures of the light emitted by the two LEDs 110, 120 may depend on the embodiment but in some embodiments, the first LED 110 may emit white light with a warm color temperature similar to that of an incandescent light (e.g. 3200K) and the second LED 120 may emit a white light with a cool color temperature (e.g. 9000K). In other embodiments, the first LED 110 may emit white light with a slightly warm color temperature (e.g. 4000K) and the second LED 120 may emit white light with a color temperature similar to daylight (e.g. 6500K). By blending the light emitted by the two LEDs 110, 120, it may be possible to generate a white light with a different color temperature than the two LEDs 110, 120.

To accomplish the blending of the light from the two LEDs 110, 120, various embodiments may essentially treat the two LEDs 110, 120 as a single, bidirectional hybrid LED so that if current flows in one direction, light of the first color temperature is emitted and if current flows in the other direction, light of the second color temperature is emitted. Since current can flow in only one direction at any given point in time, the hybrid LED may accept the max current of one LED die at a time, reducing the maximum current requirements from the power supply 130 and therefore reducing the maximum cooling requirements of any thermal solution to that of a single LED die even though two LED dies are included in the embodiment.

Embodiments may create the hybrid LED by connecting the anode 111 of the first LED 110 to the cathode 122 of the second LED 120 to create a first terminal of the hybrid LED. The cathode 112 of the first LED 110 and the anode 121 of the second LED 120 may be connected to create a second terminal of the hybrid LED. The first terminal of the hybrid LED may be connected to a first connection 131 of the power supply 130 and the second terminal of the hybrid LED may be connected to the second connection 132 of the power supply 130. The power supply 130 may be configured to create an alternating current flowing between the first connection 131 and the second connection 132 of the power supply 130.

The alternating current of the power supply 130 may have a duty cycle that may be managed by a controller 140. Some embodiments may include a network adapter 160 in communication with the controller 140. The network adapter 160 may connect to a network and in some embodiments, may have an antenna 161 for connecting to a radio frequency network such as an 802.11 Wi-Fi network, an 802.15 Zigbee network, a Z-wave network, or other wireless network. In other embodiments, a power line network may be used, such as X10 or HomePlug. In additional embodiments, a wired network could be used such as Ethernet (IEEE 802.3). In other embodiments, an optical network might be employed and some embodiments may utilize a heterogeneous network with multiple types of networks.

The controller 140 in some embodiments may include a microprocessor, a microcontroller or other computer running a software program. In other embodiments, the controller 140 may include a finite state machine or other circuitry. Other embodiments may utilize elements of both approaches. In some embodiments, the network adapter 160 may be integrated into a single device with the controller 140, such as the Zensys ZM3102 microcontroller with Z-wave network adapter. The controller 140 may have memory such as random access memory (RAM), non-volatile flash memory, read only memory (ROM), and/or other memory type that may be useful for storing computer programs and/or data.

The controller 140 may set (or manage or control) a duty cycle of the alternating current created by the power supply 130. The duty cycle may refer to periods of time that the alternating current may flow in one direction, periods of time that the alternating current may flow in the opposite direction, and/or periods of time that the alternating current may not be flowing in either direction. In many embodiments, the duty cycle may repeat in regular patterns (or cycles) for long periods of time but other embodiments may not have regular patterns for the duty cycle. The length of a cycle may be kept short to minimize flickering of the lighting apparatus 100. In most embodiments, the frequency of the cycle may be about 50 Hz or higher and in many embodiments may be greater than about 200 Hz. Some embodiments may utilize much higher frequency cycles well in excess of 1000 Hz. The duty cycle may be changed to create a different color temperature and/or brightness of the lighting apparatus 100. In some embodiments, the controller 140 may also set a current level of the power supply 130 to set a brightness of the lighting apparatus 100 instead of, or in addition to, setting the duty cycle.

Figure 2A:
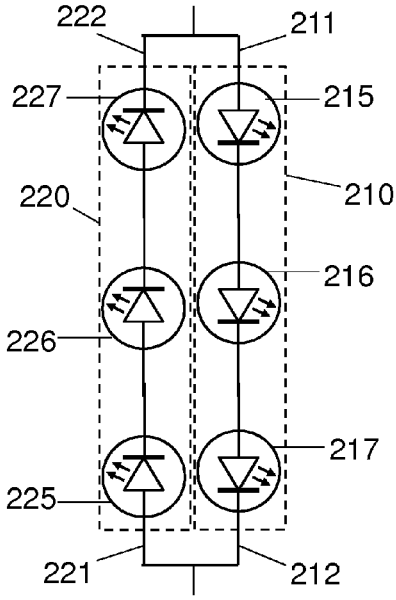
FIG. 2A and 2B show alternative embodiments of lighting elements.
Figure 2B:
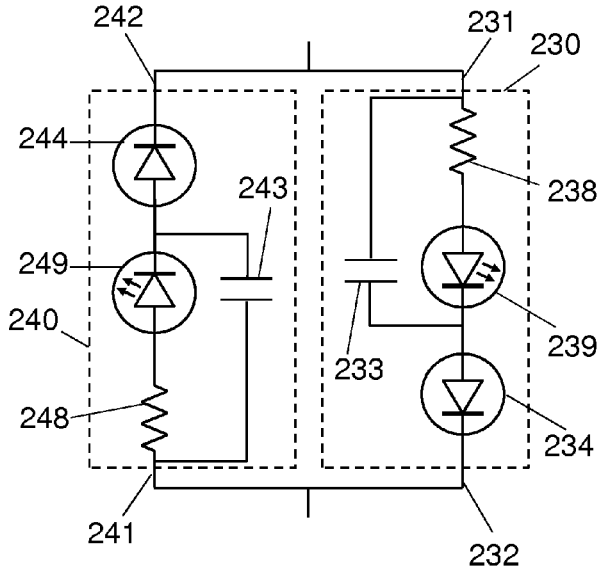

FIGS. 2A and 2B show alternative embodiments of lighting elements that may be used in the lighting apparatus 100 in place of LEDs 110, 120. FIG. 2A shows a first lighting element 210 with an anode 211 and a cathode 212 that is made up of three LEDs 215, 216, 217 connected in series. A second lighting element 220 with an anode 221 and a cathode 222 is also made up of three LEDs 225, 226, 227. The two lighting elements 210. 220 are connected so that the anode 211 of the first lighting element 210 is connected to the cathode 222 of the second lighting element 220 and the cathode 212 of the first lighting element 210 is connected to the anode 221 of the second lighting element 220. The LEDs 215, 216, 217 of the first lighting element in some embodiments may be homogenous (of the same type) emitting light of the first color temperature. In other embodiments, the LEDs 215, 216, 217 may be heterogeneous so that LED 215 may emit light with a first spectral characteristic, the LED 216 may emit light with a second spectral characteristic and the third LED 217 may emit light with a third spectral characteristic. The combined output of the three LEDs 215. 216, 217 may provide white light of the first color temperature. In some embodiments, LED 215 may be a red LED, LED 216 may be a green LED, and LED 217 may be a blue LED. Similarly, the LEDs 225, 226, 227 of the second lighting element may be homogenous or heterogeneous but still produce white light of the second color temperature. Any number of LEDs may be used for each lighting element 210, 220 and, in some embodiments, other electronic components, such as, but not limited to, diodes, resistors, capacitors, inductors, transistors and/or other types of lighting elements may be included in the lighting elements 210, 220.

One such alternative embodiment with additional electronic components is shown in FIG. 2B. A first lighting element 230 with an anode 231 and a cathode 232 may include an LED 239 that emits light at the first color temperature. A diode 234 and a resistor 238 may be included in series with the LED 239 and a capacitor 233 may be included in parallel with the LED 239 although other components, such as resistor 238, may be included in the path parallel with the capacitor 233. Other embodiments not include the resistor and/or capacitor but simply provide a diode in series with the LED in the lighting element. The second lighting element 240 with an anode 241 and a cathode 242 may be configured in a similar manner with LED 249 that emits light at the second color temperature, resistor 248 and diode 244 in series with the LED 249 and capacitor 243 in parallel with the LED 249. The anode 231 of the first lighting element 230 is connected to the cathode 242 of the second lighting element 240 and the cathode 232 of the first lighting element 230 is connected to the anode 241 of the second lighting element 240.

As current flows from the anode 231 to the cathode 232 of the first lighting element 230 causing LED 239 to emit light, the capacitor 233 may charge to a voltage value greater than the forward voltage of the LED 239 due to the voltage drop across the resistor 238. Then if the current reverses direction, causing the second lighting element 240 to emit light, the diode 234 blocks the reversed current from rapidly discharging the capacitor 233 so that the capacitor can provide current to the LED 239 through resistor 238 for some period of time depending on the capacitance of the capacitor 233, the resistance of the resistor 238 and the forward voltage of the LED 239. The additional period of time for the LED 239 to emit light after the second lighting element 240 has turned on may help to reduce flicker of the lighting apparatus 100.

Figure 3A:
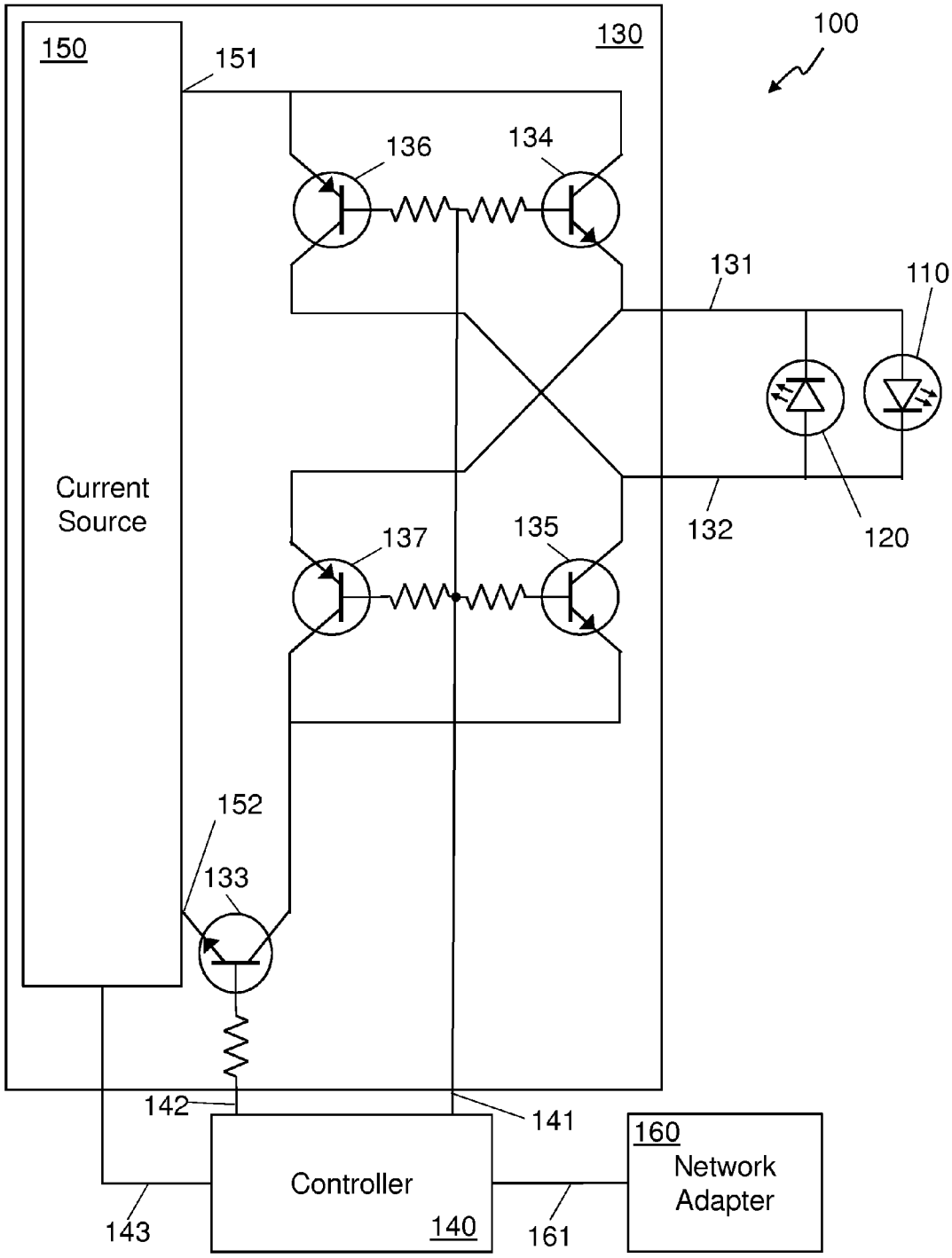
FIG. 3A is a more detailed block diagram of an embodiment of the lighting apparatus of FIG. 1.

FIG. 3A is a more detailed block diagram of an embodiment of the lighting apparatus 100. LEDs 110, 120 may be configured as in FIG. 1 and connected to the first connection 131 and second connection 132 of the power supply 130. The power supply 130 may include a current source 150 capable of delivering a relatively constant current over a range of voltage. The current source 150 may provide the current through its two terminals 151, 152 with current flowing from terminal 151 to terminal 152. Circuitry may be provided in the power supply to convert the relatively constant direct current (DC) to an alternating current (AC) at the output 131, 132 of the power supply 130. One such embodiment may include switching transistors 133-137 controlled by the controller 140. Transistor 133 may be used to turn the current from the current source 150 on or off. The base of transistor 133 may be driven through a resistor by a control line 142 from the controller 140 so that the transistor 133 may be on if the control line 142 is high and the transistor 133 may be off if the control line 142 is low. The exact voltage required for high and low may be dependent on the embodiment but should be easily calculated by one of ordinary skill in the art.

Control line 141 from the controller 140 may be used to switch the direction of the current. If control line 141 is high, the base of transistors 134-137 may be driven high through individual resistors. PNP transistors 136-137 may be turned off if their base is driven high but npn transistor 134 and npn transistor 135 may be turned on, allowing current to flow from output terminal 151 of the current source, through transistor 134, LED 110, transistor 135 and transistor 133 (if control line 142 is also high), to return terminal 152 of the current source 150. If control line 141 is low, the base of transistors 134-137 may be held low through individual resistors. NPN transistors 134-135 may be turned off if their base is held low but pnp transistor 136 and pnp transistor 137 may be turned on, allowing current to flow from output terminal 151 of the current source, through transistor 136, LED 120, transistor 137 and transistor 133 (if control line 142 is also high), to return terminal 152 of the current source 150. The controller 140 may control the direction of current flowing from the power supply 130 by driving control line 142 high and switching control line 141 between high and low. Various embodiments may use different techniques and/or circuitry to create a power supply that can generate an alternating current managed by a controller utilizing circuitry including but not limited to field effect transistors (FETs), darlington transistor pairs, relays, transformers, or other circuitry. Some embodiments may provide an alternating current as a square wave such as the circuitry shown in FIG. 3A but other embodiments may provide different waveforms such as a sine wave or other waveform shapes.

The controller 140 may also have a control line(s) 143 to the current source 150 to set a current level. The control line(s) 143 may have an analog signal level, a modulated digital line using pulse width modulation or other technique, be multiple binary lines, or utilize other communication techniques to allow the controller 140 to tell the power supply 130 what current level to set. Some embodiments may utilize control line(s) 143 in place of control line 142 to turn the current on and off. Some embodiments may have one or both of control lines 142 and 143 while others may not have either control line 142, 143.

The controller 140 may use control lines 141, 142, 143 to manage the duty cycle of the alternating current of the power supply 130. The network adapter 160 may receive information from a network and provide the information to the controller 140 over communication link 161. The information may be used by the controller to determine a duty cycle and/or current level of the alternating current of the power supply 130 to manage the color temperature and/or brightness of the lighting apparatus 100.

In some embodiments, a single control line between the controller 140 and the power supply 130 may be used for managing both the color temperature and the brightness of the lighting apparatus 100. In some embodiments, the duty cycle of the single control line may be used to manage the color temperature and the voltage level of the single control line may be sampled by the power supply to set the brightness. In other embodiments, the single control line may implement a communications protocol such as a universal asynchronous receive/transmit (UART) type protocol, or other self-clocking serial interface, standard or proprietary.

Figure 3B:
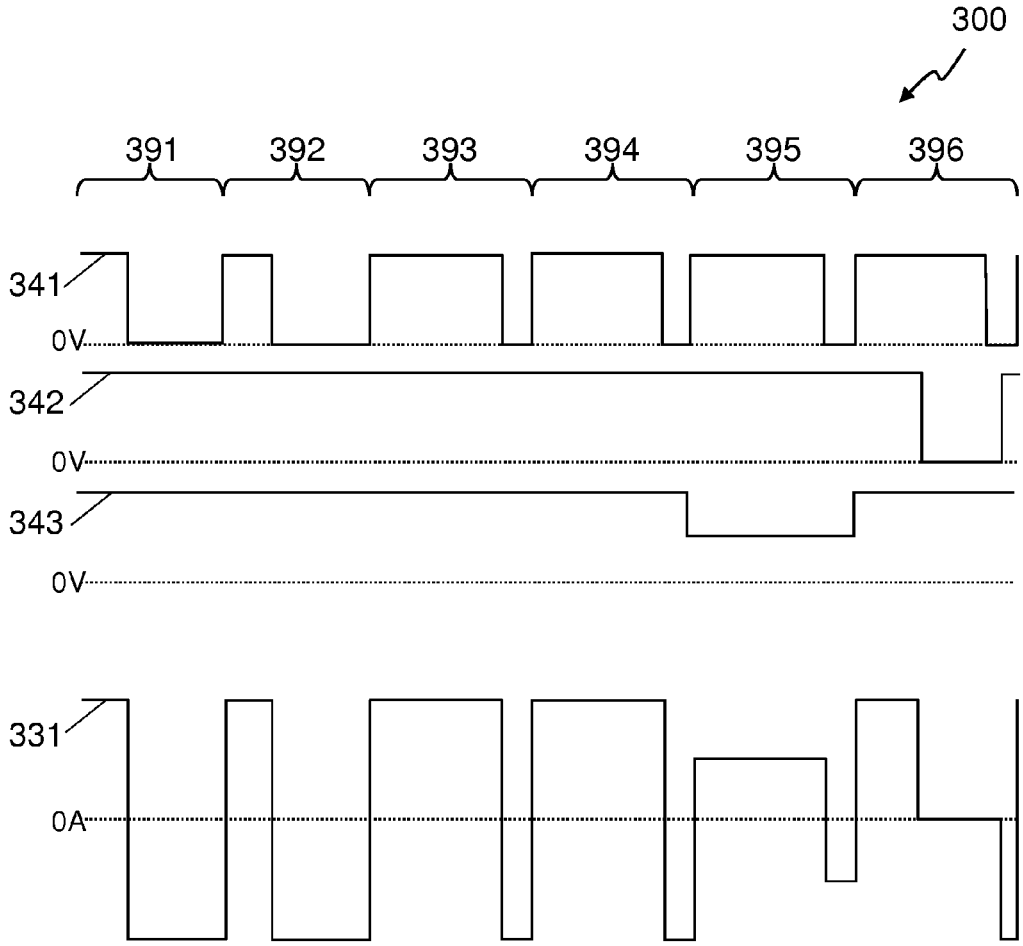
FIG. 3B shows electrical waveforms of various points in the block diagram of FIG. 3A.

FIG. 3B shows electrical waveforms of various points in the block diagram of FIG. 3A. In the embodiment shown, the controller manages the duty cycle for repeating periods 391-396 although other embodiments may not utilize repeating periods of a consistent time period. Waveform 341 is a voltage waveform of control line 141, waveform 342 is a voltage waveform of control line 142 and waveform 343 is a voltage waveform of an analog embodiment of control line 143. Waveform 331 is a current waveform of the current flowing from terminal 131 of the power supply 130 and flowing through the LEDs 110, 120. If the waveform 331 is positive, the current is flowing through LED 110 and if the waveform 331 is negative, the current if flowing through LED 120.

During the first two time periods 391, 392, the controller 140 may have determined that to provide the desired color temperature from the lighting apparatus 100, LED 110 should be illuminated about 33% of the time and LED 120 should be illuminated about 67% of the time. The controller 140 may have determined the desired duty cycle based on an interpolation between the color temperature of the two LEDs 110, 120, a look-up table operation based on pre-computed values, or other technique. The controller 140 may ensure that control line 142 is high and set control line 143 to its maximum value so that the maximum current for the lighting apparatus 100 can flow. The controller 140 may then drive control line 141 using various modulation techniques so that the current is flowing through LED 110 for about 33% of the time and through LED 120 for about 67% of the time. Control line 141 may be modulated using pulse density modulation (PDM), pulse width modulation (PWM) as shown in waveform 341, or other modulation techniques. Current waveform 331 shows that current is flowing through LED 110 if waveform 341 of control line 141 is high and that current is flowing through LED 120 if waveform 341 is low.

The controller 140 may receive information from the network adapter 160 or other control input that causes the controller 140 to determine that a different mix of light from the two LEDs 110, 120, such as a ratio of 5 to 1, may be desired, so the next two periods 393, 394 have a different duty cycle for the alternating current. In the example shown, periods 393, 394 have LED 110 illuminated about 80% of the time and LED 120 illuminated for about 20% of the time. The controller 140 may provide this duty cycle on control line 141 and the alternating current adjusts accordingly so that LED 110 is illuminated for about 80% of the each period and LED 120 is illuminated for about 20% of each period.

Another control input may be received by the controller 140 requesting it to set the brightness to about 50%. Period 395 shows one method that the controller 140 may use to adjust the brightness level of the lighting apparatus 100. During period 395, the controller 140 does not change the duty cycle of the alternating current but changes the current level by changing the control line 343 to a lower voltage level to tell the current source 150 to reduce the current level. Waveform 331 shows the resulting lower currents during period 395. During period 396, the controller 140 may utilize a different method of controlling the brightness of the lighting apparatus 100 by readjusting the current to the maximum level by setting control line 143 back to the maximum level but using control line 142 to turn off the alternating current for 50% of the time that the current is flowing in both directions. In the embodiment shown, waveform 331 shows that the current starts out the period 396 at a full positive level. About 40% of the time through the period 396, the control line 142 (waveform 342) is set low to shut off the current. At about 80% of the period, control line 141 (waveform 341) is set low which would normally reverse the flow of current, but since control line 142 is still low, no current flows until control line 142 is set high again at about 90% of the period. During period 396 LED 110 is on for about 40% of the period 396 and LED 120 is on for about 10% of the period 396 maintaining the ratio between LED 110 and LED 120 at about 5 to 1.

Figures 4A, 4B:
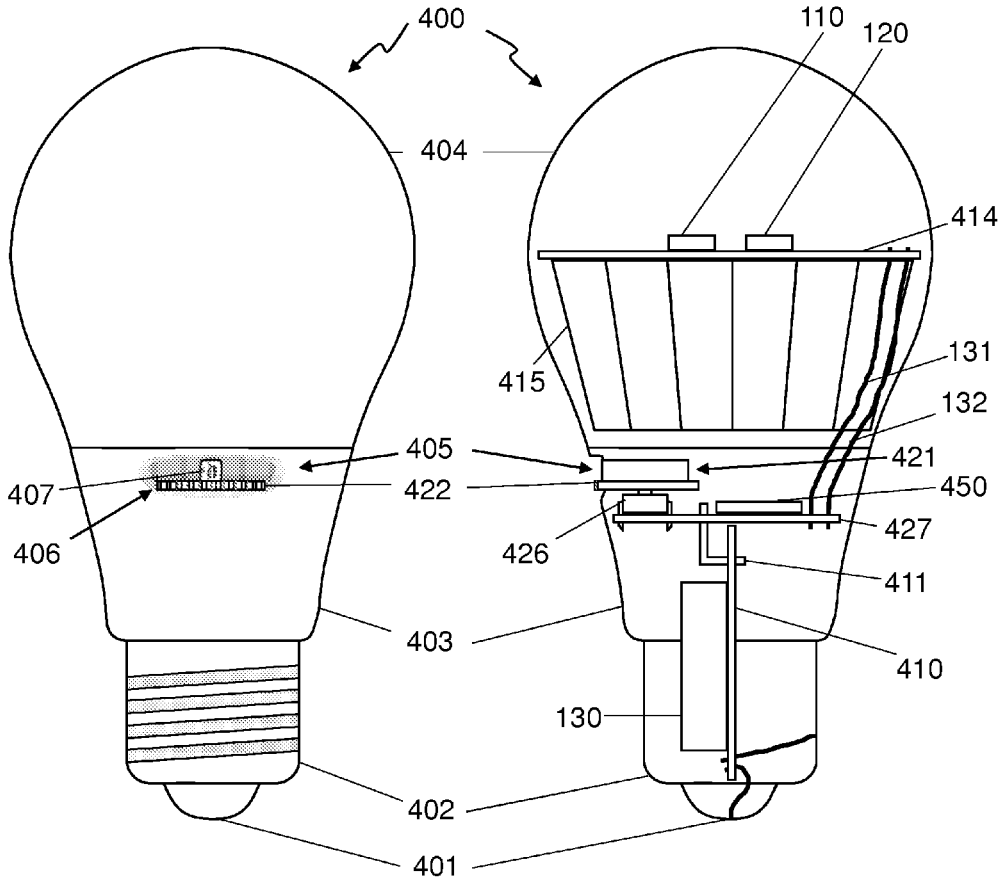
FIG. 4A is a elevational view and FIG. 4B is a cross-sectional view of an embodiment of a light bulb.

FIG. 4A is a elevational view (with inner structure not shown) and FIG. 4B is a cross-sectional view of an embodiment of a light bulb 400. Wall thicknesses of some mechanical parts are not shown to simplify the drawing. In this embodiment a networked light bulb 400 is shown but other embodiments could be a light fixture with embedded LEDs or any other sort of light emitting apparatus. The light bulb 400 may be AC powered but other embodiments could be battery powered or solar powered. The networked light bulb 400 of this embodiment may have an Edison screw base with a power contact 401 and a neutral contact 402, a middle housing 403 and an outer bulb 404. Each section 401, 402, 403, 404 may be made of a single piece of material or be assembled from multiple component pieces. In some embodiments, one fabricated part may provide for multiple sections 401, 402, 403, 404. The outer bulb 404 may be at least partially transparent and may have ventilation openings in some embodiments, but the other sections 401, 402, 403 can be any color or transparency and be made from any suitable material. The middle housing 403 may have an indentation 405 with a slot 406 and an aperture 407. A color wheel 421 useful for providing configuration information from the user may be attached to the shaft of rotary switch 426 which may be mounted on a printed circuit board 427. The printed circuit board 427 may also have a controller with integrated network adapter 450 mounted on it. The printed circuit board 427 may be mounted horizontally so that the edge 422 of the color wheel 421 may protrude through the slot 406 of the middle housing 403. This may allow the user to apply a rotational force to the color wheel 421 to change settings.

In the embodiment shown, a second printed circuit board 410 may be mounted vertically in the base of the networked light bulb 400. The second printed circuit board 410 may contain the power supply 130. A board-to-board connection 411 may be provided to connect selected electrical signals between the two printed circuit boards 427, 410. The control signals 141, 142, 143 and the power supply connections 131, 132 may be among the signals included on the board-to-board connection 411. A third printed circuit board 414 may have the LEDs 110, 120 mounted on it and it may be backed by a heat sink 415 to cool the LEDs 110, 120. In some embodiments the third printed circuit board 414 with the LEDs 110, 120 may be replaced by a single multi-die LED package. In other embodiments the third printed circuit board may contain two lighting elements each containing a plurality of components including at least one LED. A cable carrying the connections 131, 132 to the power supply 130 may connect the printed circuit board 427 with the third printed circuit board 414. In some embodiments the cable carrying the connections 131, 132 of the power supply 130 may be connect the second printed circuit board 410 directly to the third printed circuit board 414 instead of passing the signals through the printed circuit board 427.

The heat sink 415 may be a unified thermal solution providing cooling to both lighting elements, LEDs 110, 120 in the embodiment shown. The cooling capacity of the thermal solution may be larger than the maximum amount of heat generated by either lighting element alone, but smaller than the sum of the maximum amount of heat generated by the two lighting elements together. This may be done because in various embodiment both lighting elements may not be simultaneously powered due to the fact that the a lighting element can only emit light (and therefore generate heat) if current is flowing through it and the two lighting elements are configured so that current flows through one of the lighting elements if current is flowing in one direction and the other lighting element if current is flowing in the opposite direction. The unified thermal solution may be a standard extruded heat sink, a heat sink assembled from multiple components, a thermal solution utilizing a heat pipe(s) to transfer heat, a fan-sink, or any other passive or active thermal solution.

The light bulb 400 may be of any size or shape. It may be a component to be used in a light fixture or it may be designed as a stand-alone light fixture to be directly installed into a building or other structure or used as a stand-along lamp. In some embodiments, the light bulb may be designed to be substantially the same size and shape as a standard incandescent light bulb. A light bulb designed to be compliant with an incandescent light bulb standard published by the National Electrical Manufacturer's Association (NEMA), American National Standards Institute (ANSI), International Standards Organization (ISO) or other standards bodies may be considered to be substantially the same size and shape as a standard incandescent light bulb. Although there are far too many standard incandescent bulb sizes and shapes to list here, such standard incandescent light bulbs include, but are not limited to, "A" type bulbous shaped general illumination bulbs such as an A19 or A21 bulb with an E26 or E27, or other sizes of Edison bases, decorative type candle (B), twisted candle, bent-tip candle (CA & BA), fancy round (P) and globe (G) type bulbs with various types of bases including Edison bases of various sizes and bayonet type bases. Other embodiments may replicate the size and shape of reflector (R), flood (FL), elliptical reflector (ER) and Parabolic aluminized reflector (PAR) type bulbs, including but not limited to PAR30 and PAR38 bulbs with E26, E27, or other sizes of Edison bases. In other cases, the light bulb may replicate the size and shape of a standard bulb used in an automobile application, most of which utilize some type of bayonet base. Other embodiments may be made to match halogen or other types of bulbs with bi-pin or other types of bases and various different shapes. In some cases the light bulb 400 may be designed for new applications and may have a new and unique size, shape and electrical connection. Other embodiments may be a light fixture, a stand-alone lamp, or other light emitting apparatus.

Figure 5:
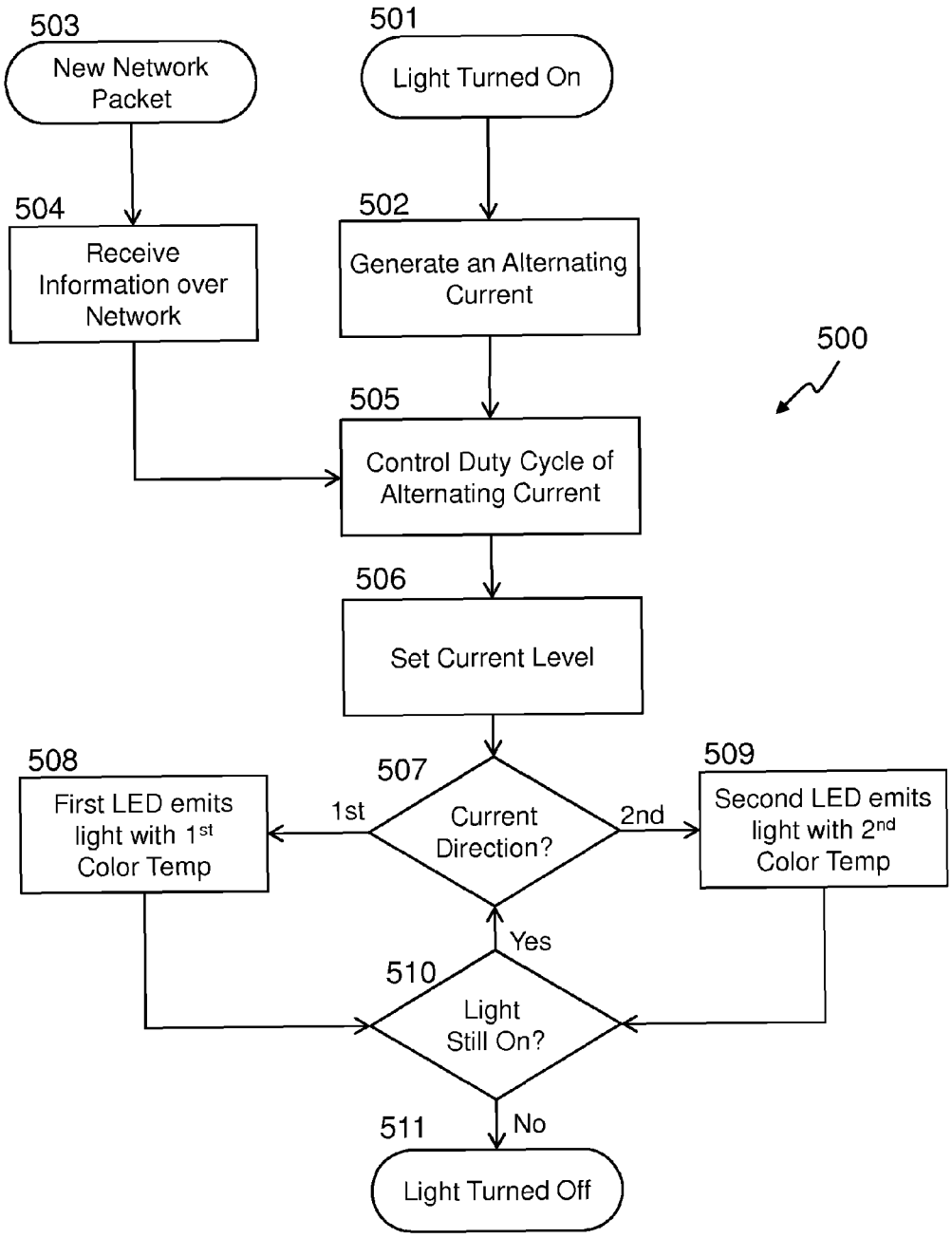
FIG. 5 is a flow chart of an embodiment of a method of using two LEDs to change the color temperature of a light.

FIG. 5 is a flow chart 500 of an embodiment of a method of using two LEDs to change the color temperature of a light. The light may be turned on at block 501 and an alternating current is generated starting at block 502 and the duty cycle of the alternating current is controlled at block 505.

A new network packet may be detected at block 503 and information received over the network at block 504. The information may pertain to a desired color temperature or brightness of the light. The information received over the network may be used to determine the desired duty cycle of the alternating current at block 505. It may also be used to set a current level of the alternating current at block 506.

The direction of the current flow at any particular point in time may be detected at block 507. If the current is flowing in a first direction, the first LED emits a white light having a first color temperature at block 508. If the current is flowing in the opposite direction, the second LED emits white light having a second color temperature at block 509. At block 510, it may be determined whether or not the light should still be on. If the light is still on, the current direction continues to be evaluated at block 507. If the light is off, the method ends at block 511.

Unless otherwise indicated, all numbers expressing quantities of elements, optical characteristic properties, and so forth used in the specification and claims are to be understood as being modified in all instances by the term "about." Accordingly, unless indicated to the contrary, the numerical parameters set forth in the preceeding specification and attached claims are approximations that can vary depending upon the desired properties sought to be obtained by those skilled in the art utilizing the teachings of the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviations found in their respective testing measurements.

The recitation of numerical ranges by endpoints includes all numbers subsumed within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. Thus, for example, reference to an element described as "an LED" may refer to a single LED, two LEDs or any other number of LEDs. As used in this specification and the appended claims, the term "or" is generally employed in its sense including "and/or" unless the content clearly dictates otherwise.

As used herein, the term "coupled" includes direct and indirect connections. Moreover, where first and second devices are coupled, intervening devices including active devices may be located there between.

Any element in a claim that does not explicitly state "means for" performing a specified function, or "step for" performing a specified function, is not to be interpreted as a "means" or "step" clause as specified in 35 U.S.C. §112, ¶6. In particular the use of "step of" in the claims is not intended to invoke the provision of 35 U.S.C. §112, ¶6.

The description of the various embodiments provided above is illustrative in nature and is not intended to limit the invention, its application, or uses. Thus, variations that do not depart from the gist of the invention are intended to be within the scope of the embodiments of the present invention. Such variations are not to be regarded as a departure from the intended scope of the present invention.

What is claimed is:

1. A method of controlling color temperature of a lighting apparatus, the method comprising:

generating an alternating current, wherein said alternating current flows in a first direction for a first amount of time and said alternating current flows in an opposite direction for a second amount of time during a period of time;

sending said alternating current to a set of light emitting diodes (LEDs) of a lighting apparatus, wherein at least a first subset of the set of LEDs emits a white light with a first color temperature if said alternating current flows in the first direction and at least a second subset of the set of LEDs emits a white light with a second color temperature if said alternating current flows in the opposite direction;

cooling the set of LEDs with a unified thermal solution having a cooling capacity that is smaller than a sum of a maximum heat generated by the first subset of the set of LEDs and a maximum heat generated by the second subset of the set of LEDs; and controlling a ratio of said first amount of time to said second amount of time to control a color temperature of light emitted by the lighting apparatus during said period of time.

2. The method of claim 1, further comprising:

controlling a ratio of said period of time to a sum of said first amount of time and said second amount of time to control a brightness of the lighting apparatus.

3. The method of claim 1, further comprising:

controlling a current level of said alternating current to control a brightness of the lighting apparatus.

4. The method of claim 1, further comprising:

receiving information over a network about a desired color temperature of the lighting apparatus; and controlling said ratio of said first amount of time to said second amount of time based on said information about the desired color temperature.

5. The method of claim 1, further comprising:

receiving information over a network about a desired brightness of the lighting apparatus; and controlling a ratio of said period of time to a sum of said first amount of time and said second amount of time based on said information about the desired brightness.

6. The method of claim 1, further comprising:

receiving information over a network about a desired brightness of the lighting apparatus; and controlling a current level of said alternating current to control a brightness of the lighting apparatus based on said information about the desired brightness.

7. A lighting apparatus comprising:

a power supply comprising a first electrical connection and a second electrical connection, said power supply configured to create an alternating current flowing between the first electrical connection and the second electrical connection;

a first lighting element comprising a first light emitting diode (LED), the first lighting element having a first anode electrically coupled to the first electrical connection of said power supply and a first cathode electrically coupled to the second electrical connection of said power supply, said first lighting element configured to emit a white light having a first color temperature if current flows through the first lighting element from the first anode to the first cathode;

a second lighting element comprising a second LED, the second lighting element having a second anode electrically coupled to the second electrical connection of said power supply and a second cathode electrically coupled to the first electrical connection of said power supply, said second lighting element configured to emit a white light having a second color temperature if current flows through the second lighting element from the second anode to the second cathode;

a unified thermal solution capable of cooling the said first lighting element and said second lighting element, wherein said unified thermal solution has a cooling capacity that is smaller than a sum of a maximum heat generated by said first lighting element and a maximum heat generated by said second lighting element; and a controller communicatively coupled with said power supply and configured to manage a color temperature of the lighting apparatus by controlling a duty cycle of said alternating current created by said power supply.

8. The lighting apparatus of claim 7, wherein said controller is further configured to set a brightness of the lighting apparatus by controlling said duty cycle of said alternating current created by said power supply.

9. The lighting apparatus of claim 7, wherein said controller is further configured to change a brightness of the lighting apparatus by changing a current level of said alternating current created by said power supply.

10. The lighting apparatus of claim 7, wherein a single control line is provided for communication between said controller and said power supply, the single control line used to both manage said color temperature of the lighting apparatus and to set a brightness of the lighting apparatus.

11. The lighting apparatus of claim 7, wherein said first lighting element further comprises a first diode in series with the first LED; and said second lighting element further comprises a second diode in series with the second LED.

12. The lighting apparatus of claim 7, wherein said first lighting element further comprises one or more added LEDs connected in series with the first LED; and said second lighting element further comprises one or more additional LEDs connected in series with the second LED.

13. The lighting apparatus of claim 7, further comprising:

a network adapter communicatively coupled to the controller and configured to receive data over a network and provide the data to said controller;

wherein said controller is further configured to use the data received over the network to manage said color temperature of the lighting apparatus.

14. The lighting apparatus of claim 13, wherein said controller is further configured to use the data received over the network to set a brightness of the lighting apparatus.

15. A light bulb comprising:

a first lighting element comprising at least a first light emitting diode (LED) and a first diode connected in series, the first lighting element having a first anode and a first cathode and configured to emit a white light having a first color temperature if current flows through the first lighting element from the first anode to the first cathode;

a second lighting element comprising at least a second LED and a second diode connected in series, the second lighting element having a second anode and a second cathode and configured to emit a white light having a second color temperature if current flows through the second lighting element from the second anode to the second cathode;

a power supply comprising a first electrical connection that is electrically connected to the first anode of the first lighting element and the second cathode of the second lighting element, and a second electrical connection that is electrically connected to the first cathode of the first lighting element and the second anode of the second lighting element, said power supply configured to create an alternating current flowing between the first electrical connection and the second electrical connection;

a unified thermal solution capable of cooling the first lighting element and the second lighting element, wherein said unified thermal solution has a cooling capacity of at least the larger of a maximum heat generated by the first lighting element and a maximum heat generated by the second lighting element but smaller than a sum of the maximum heat generated by the first lighting element and the maximum heat generated by the second lighting element;

a controller communicatively coupled to said power supply;

a network adapter communicatively coupled to the controller and configured to receive data over a network and provide the data to said controller;

a base with an electrical power contact electrically coupled to the power supply; and a shell connected to the base and containing the first lighting element, the second lighting element, the power supply, the unified thermal solution, the controller and the network adapter, said shell at least partially transparent and substantially the same size and shape as a typical incandescent light bulb;

wherein said controller is configured to manage a color temperature of the light bulb by controlling a duty cycle of said alternating current created by said power supply based on the data received over the network and to use the data received over the network to set a brightness of the light bulb.

16. The light bulb of claim 15, wherein said brightness is set by controlling said duty cycle of said alternating current created by said power supply.

17. The light bulb of claim 15, wherein said brightness is set by controlling a current level of said alternating current created by said power supply.

18. The light bulb of claim 15, wherein said first lighting element further comprises one or more added LEDs connected in series with the first LED; and said second lighting element further comprises one or more additional LEDs connected in series with the second LED.

19. The method of claim 1, wherein the cooling capacity of the unified thermal solution is at least as much as the larger of the maximum heat generated by the first subset of the set of LEDs or the maximum heat generated by the second subset of the set of LEDs.

20. The lighting apparatus of claim 7, wherein the cooling capacity of the unified thermal solution is at least as much as the larger of the maximum heat generated by the first lighting element or the maximum heat generated by the second lighting element.

* * * * *